United States Patent [19]

King et al.

[11] Patent Number: 4,667,756

[45] Date of Patent: May 26, 1987

[54] MATRIX BIT WITH EXTENDED BLADES

[75] Inventors: William W. King, Houston; Arthur M. Handsel, Spring; David M. Nguyen, Houston, all of Tex.

[73] Assignee: Hughes Tool Company-USA, Houston, Tex.

[21] Appl. No.: 867,343

[22] Filed: May 23, 1986

[51] Int. Cl.[4] ..... E21B 10/36

[52] U.S. Cl. ..... 175/409; 175/417; 76/108 A

[58] Field of Search ..... 175/409, 329, 414, 415, 175/416, 417, 418, 419, 420; 76/108 A

[56] References Cited

U.S. PATENT DOCUMENTS

| | | | |
|---|---|---|---|
| 3,757,878 | 9/1973 | Wilder et al. | 175/329 |
| 3,757,879 | 9/1973 | Wilder et al. | 175/409 |
| 3,825,083 | 7/1974 | Flarity et al. | 175/329 |
| 4,351,401 | 9/1982 | Fielder | 175/329 |
| 4,440,247 | 4/1984 | Sartor | 175/393 |
| 4,460,053 | 7/1984 | Jürgens et al. | 175/329 |

OTHER PUBLICATIONS

*Engineering Update*, vol. 6, No. 3, Nov. 1985.

*Primary Examiner*—Stephen J. Novosad
*Assistant Examiner*—Terry Lee Melius
*Attorney, Agent, or Firm*—Charles D. Gunter, Jr.

[57] ABSTRACT

A matrix bit is shown of the type having a metallic mandrel with a connecting end for connection in a well pipe string leading to the well surface. An opposite end is covered with a cast matrix material which defines a central bit body. A plurality of integral blades are formed of the cast matrix material and extend axially and radially from the central bit body. Each of the blades is reinforced by a metallic extension which is contained within the matrix material and extends coaxially with each blade.

5 Claims, 4 Drawing Figures

MATRIX BIT WITH EXTENDED BLADES

BACKGROUND OF THE INVENTION

1. Field of the Invention

The present invention relates to earth boring drill bits and specifically, to such bits formed with cast matrix material of a hard wear resistant material.

2. Description of the Prior Art

Diamond "matrix" drill bits are known in which a metallic mandrel has bonded thereto a matrix body of tungsten carbide. The matrix is formed or "cast" by allowing molten metal to infiltrate a body of discrete tungsten carbide in a suitable mold. The matrix body of the bit can have diamonds which are arranged to define cutting edges on the external surface of the bit body. Certain of the prior art bits have been formed with a bit body of generally conical cross-sectional area and having blades which extend axially and radially outward from the bit body to form flat, wing-like projections extending outwardly from the bit face. Typical prior art bits have embodied blades which have extended as much as about 1½ inches from the bit body. Greater blade exposure resulted in gross failure due to unsupported matrix fracture.

The present invention has as its object, the provision of a matrix bit which makes possible the economical use of case tungsten carbide and which provides cast matrix bits having blades with greater standoff from the bit body than was previously possible.

SUMMARY OF THE INVENTION

The matrix bit of the invention includes a metallic mandrel having an interior bore, a connecting end for engaging the mating connecting end of a pipe string extending to the well surface, and an opposite end covered with a cast matrix material which defines a central bit body. The cast matrix material has a wear resistance substantially greater than that of the metallic mandrel. A plurality of integral blades are formed of the central bit material and extend axially and radially from the cast matrix body. Each of the blades terminates in a relatively flat portion having cutting edges with cutting elements positioned thereon. Each of the blades is reinforced by a metallic extension contained within the cast matrix material of the blade. The metallic extension is preferably affixed to the mandrel and extends coaxially with the blade. By providing metallic extensions which run from the metallic mandrel for substantially the entire length of the respective blades, a matrix bit can be provided with blades having greater standoff than was heretofore possible and which does not suffer from gross failure due to unsupported matrix fracture.

Additional objects, features and advantages will be apparent in the description which follows.

DETAILED DESCRIPTION OF THE INVENTION

Figure 1:
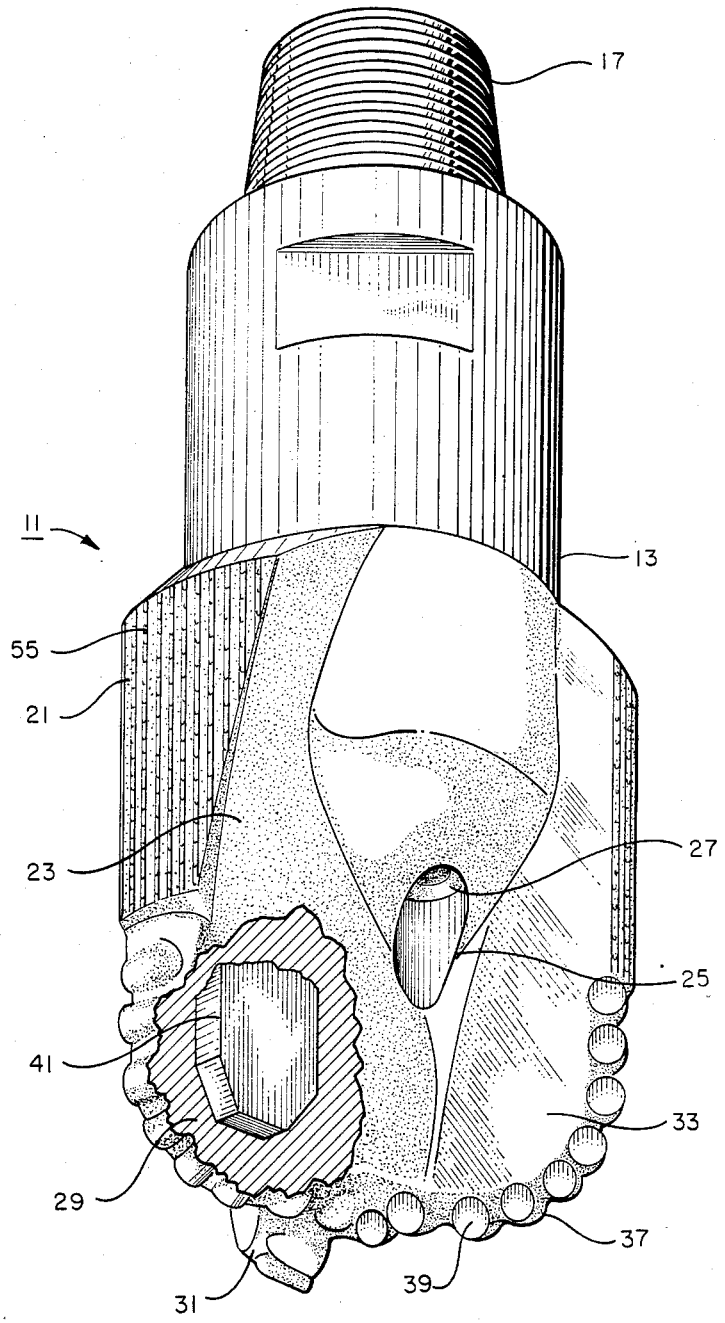
FIG. 1 is a perspective view of a matrix bit of the invention, partly broken away to show the metallic extensions contained within the blades of the bit.

FIG. 1 shows a matrix bit of the invention designated generally as 11. The bit 11 has a metallic mandrel 13 having an interior 15 (FIG. 3), a connecting end 17 (FIG. 1) for engaging the mating connecting end of a pipe string extending to the well surface, and an opposite cylindrical end 19 (FIG. 3) covered with a cast matrix material 21. The cast matrix material 21 defines a central bit body 23 which is preferably of generally conical cross-sectional area and which converges to a bullet-shaped nose region, indicated generally at 25 in buttlet-shaped nose region, indicated generally at 25 in FIG. 1. One or more nozzles 27 can be provided which communicate with the interior 15 of the mandrel and, through the interior of the well pipe string, to the well surface for circulating fluids to the exterior of the bit.

A plurality of integral blades 29, 31, 33 are formed of the cast matrix material and extend axially in planes parallel to the longitudinal axis 35 (FIG. 3) of the bit and radially outward to terminate in relatively flat portions having cutting edges 37 with cutting elements 39 located thereon. The cutting elements 39 can be, for instance, polycrystalline diamond cutting elements which are brazed within recesses provided along the cutting edges 37, or can be thermally stable polycrystalline diamond elements which are cast in the matrix material 21. The matrix material has a wear resistance substantially greater than that of the metallic mandrel 13.

Each of the blades 29, 31, 33 is reinforced by a metallic extension 41 which is contained within the cast matrix material of the blade. The metallic extension 41 is preferably affixed to the mandrel 13 and extends coaxially with each blade. For instance, the metallic extension 41 can be tack welded, glued, press fit, brazed, or the like to the metallic mandrel 13. In the example shown in FIG. 3, the metallic extension 41 is tack welded within slots formed in the cylindrical end 19 of the mandrel 13 at equi-distant spaced circumferential locations about the cylindrical end 19.

Figure 3:
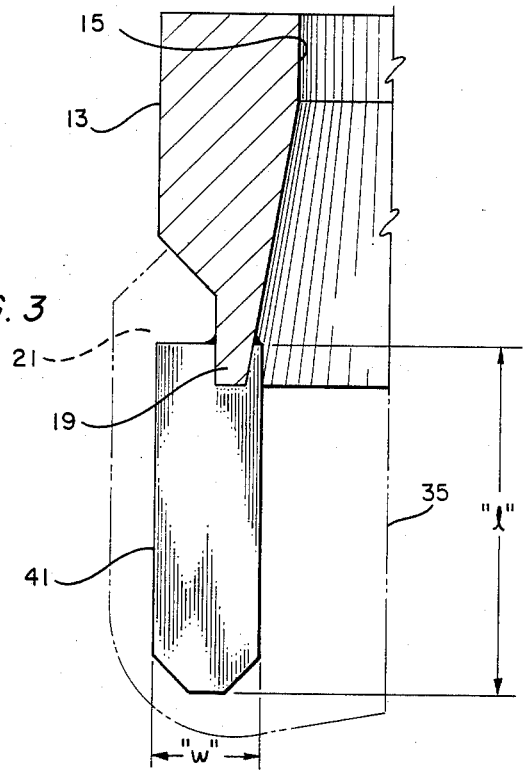
FIG. 3 is a side, cross-sectional view of the bit taken generally along lines III—III in FIG. 2.

As shown in FIG. 3, each metallic extension has a length "l" and a width "w", the length of each extension being at least twice the width therefore. Preferably, the length of each of the metallic extensions 41 which extends from the mandrel end 19 is at least one about 1½ inches, or in the range of 3–4 times the width thereof.

Figure 2:
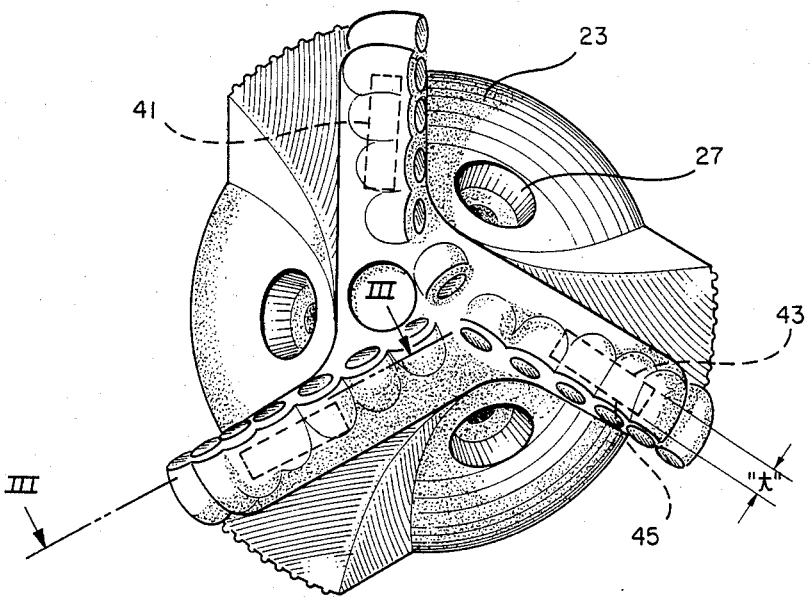
FIG. 2 is a top, perpsective view of the bit of FIG. 1 showing the location of the metallic extensions within the bit blades in dotted lines.

As shown in FIG. 2 and 3, the metallic extensions 41 have generally rectangular planar faces 43, 45 separated by a uniform thickness "t", As best shown in FIG. 3, each metallic extension 41 runs for substantially the entire length of the respective blade and terminates in the vicinity of the outer cutting edge of the blade.

Figure 4:
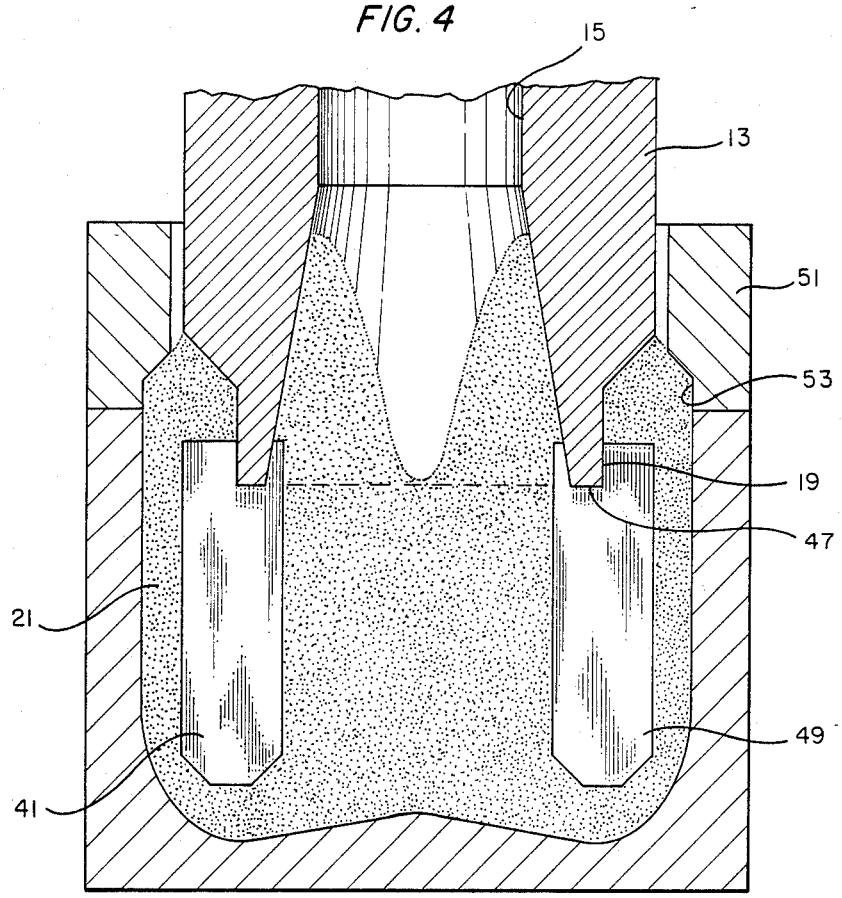
FIG. 4 is a simplified, cross-sectional view of the manufacturing process used to produce the bit of FIG. 1, showing the components thereof in a mold.

The method for manufacturing the matrix bit of the invention will now be described, primarily with reference to FIG. 4. A metallic mandrel 13 is fashioned having a interior 15, a connecting end as shown in FIG. 1, and an opposite end 19 which terminates in a circular opening 47. The metallic extensions (41, 49 shown in FIG. 4) are affixed to the opposite end 19 of the mandrel 13 to transversely intersect the circumference of the opening 47 at equally spaced circumferential locations.

A mold 51 is then provided having an interior space 53. The mold 51 is preferably fabricated from graphite and which has a precisely machined interior 53 to form a negative of what will become the bit profile. The interior 53 is milled and dressed to form the proper contours of the finished bit and diamonds may be placed along the location of the cutting edges 37 and along the gage area 55 (FIG. 1). Flow slots and other external features of the bit profile can be provided by adding sand to the mold to displace the matrix material which is to be added. Nozzle displacement areas are also formed in the mold and a layer of tungsten carbide powder, binders and flux are placed into the mold.

Vertical slots are then formed in the bottom of the mold by means of said displacements. The metallic mandrel 13 with extensions attached is then inserted into the mold with the extensions positioned toward the bottom of the mold interior 53. The mandrel acts as a ductile core to which the matrix material adheres during the casing and cooling stage. The extensions 41 are aligned within the slots allowing a small amount of matrix material to contain the metallic extensions within each slot and form each blade.

The bit and mold are placed in a furnace at a temperature and for a time sufficient to allow the binder metals to melt and infiltrate the tungsten carbide and wet the metallic mandrel. Further details of the process for manufacuring matrix type diamond bits can be found, for instance, in U.S. Pat. No. 3,747,878 to Wilder et al., issued Sept. 11, 1973, the disclosure of which is hereby incorporated by reference.

An invention has been provided with several advantages. The matrix bits of the invention are made with extended blades having metallic reinforcement areas which prevent gross failure in even highly extended blade bits. Because more metal and less matrix material is utilized in the manufacturing process, a cost savings can be realized. While the invention has been shown in only one of its forms, it is not thus limited but is susceptible to various changes and modifications without departing from the spirit thereof.

We claim:

1. A matrix bit of the type used in drilling oil and gas wells, comprising:

a metallic mandrel having an interior bore, a connecting end for engaging the mating connecting end of a pipe string extending to the well surface, and an opposite cylindrical end covered with a cast matrix material which defines a central bit body, the cast matrix material having a wear resistance substantially greater than that of the metallic mandrel;

a plurality of integral blades formed of the cast matrix material and extending axially and radially from the body; and each of said blades being reinforced by a metallic extension contained within the matrix material and extending coaxially from the cylindrical end within each blade for substantially the length of each blade, and wherein each metallic extension has a length which extends away from the cylindrical end parallel to the longitudinal axis of the bit and a width which extends away from the cylindrical end transverse to the longitudinal axis of the bit, the length and width of the metallic extensions defining a pair of planar faces separated by a thickness, each of said metallic extensions being affixed to the mandrel cylindrical end at equidistant, spaced circumferential locations, the length of said extensions being at least twice the width thereof.

2. A matrix bit of the type used in drilling oil and gas wells, comprising:

a metallic mandrel having an interior, a connecting end for engaging the mating connecting end of a pipe string extending to the well surface, and an opposite cylindrical end covered with a cast matrix material which defines a central bit body of generally conical cross-sectional area, the cast matrix material having a wear resistance substantially greater than that of the metallic mandrel;

a plurality of integral blades formed of the cast matrix material and extending axially and radially from the central bit body and terminating in relatively flat portions having cutting edges with cutting elements located thereon; and each of said blades being reinforced by a metallic extension contained within the cast matrix material of the blade, the metallic extension being affixed to said mandrel and extending coaxially from the cylindrical end within each blade over substantially the length of each blade, and wherein each metallic extension is a paddle-shaped member having a length which extends away from the cylindrical end parallel to the longitudinal axis of the bit and a width which extends away from the cylindrical end transverse to the longitudinal axis of the bit, the length and width of the metallic extensions defining a pair of generally rectangular planar faces separated by a uniform thickness, each of said metallic extensions being affixed to the mandrel cylindrical end at equidistant, spaced circumferential locations, the length of said extensions being at least twice the width thereof.

3. The matrix bit of claim 2, wherein the length of each of said metallic extensions which extends axially from said mandrel cylindrical end is greater than about 1½ inches.

4. The matrix bit of claim 2, wherein said mandrel cylindrical end terminates in a circular opening and wherein said metallic extensions are affixed at said circular opening to transversely intersect the circumference of the opening at equally spaced circumferential locations.

5. A method of manufacturing a matrix bit of the type used in drilling oil and gas wells, comprising:

fashioning a metallic mandrel having an interior, a connecting end for engaging the mating connecting end of a pipe string extending to the well surface, and an oppsoite generally cylindrical end;

affixing a plurality of metallic extensions to said opposite end, each of said extensions having a length which extends away from the cylindrical end parallel to the longitudinal axis of the bit and a width which extends away from the cylindrical end transverse to the longitudinal axis of the bit, the length and width of the metallic extensions defining a pair of planar surfaces separated by a thickness, the length of said extensions being at least twice the width thereof;

inserting the metallic mandrel, opposite end first, into a mold having an interior space;

filling the space about said opposite end in said mold with a matrix material which, when cast, defines a central bit body of generally conical cross-sectional area, the cast matrix material having a wear resistance substantially greater than that of the metallic mandrel;

positioning the matrix material within said mold to define a plurality of integral blades formed of the cast matrix material which extend axially and radially from the central bit body, each of said blades being reinforced by one of said metallic extensions affixed to said mandrel and contained within and extending coaxially with said blade for substantially the entire length of said blade; and heating the mold in a furnace for a time and at a temperature sufficient to bond the matrix material to the metallic mandrel and metallic extensions.

* * * * *